US011043087B1

(12) United States Patent
Moulton et al.

(10) Patent No.: US 11,043,087 B1
(45) **Date of Patent: *Jun. 22, 2021**

(54) THERMOSTAT WITH DOWNCAST LIGHT

(71) Applicant: Vivint, Inc., Provo, UT (US)

(72) Inventors: Michael Scott Moulton, Heber City, UT (US); Craig DeVries, Bountiful, UT (US); Stephen Edward Boynton, Pleasant Grove, UT (US); Kris Nosack, Orem, UT (US); Greg Cooper, Highland, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/200,266

(22) Filed: Nov. 26, 2018

Related U.S. Application Data

(63) Continuation of application No. 15/424,232, filed on Feb. 3, 2017, now Pat. No. 10,140,821.

(51) Int. Cl.

| | |
|---|---|
| ***G08B 5/36*** | (2006.01) |
| ***F24F 11/00*** | (2018.01) |
| ***F24F 11/61*** | (2018.01) |
| ***F24F 11/30*** | (2018.01) |
| ***F24F 11/65*** | (2018.01) |
| ***F24F 11/52*** | (2018.01) |
| ***F24F 11/62*** | (2018.01) |
| *F24F 11/56* | (2018.01) |
| *F24F 120/10* | (2018.01) |
| *F24F 110/10* | (2018.01) |

(52) U.S. Cl.
CPC ..... *G08B 5/36* (2013.01); *F24F 11/30* (2018.01); *F24F 11/52* (2018.01); *F24F 11/61* (2018.01); *F24F 11/62* (2018.01); *F24F 11/65* (2018.01); *F24F 11/56* (2018.01); *F24F 2110/10* (2018.01); *F24F 2120/10* (2018.01)

(58) Field of Classification Search
CPC ... G08B 5/36; F24F 11/52; F24F 11/65; F24F 11/61; F24F 11/62; F24F 11/30; F24F 11/56; F24F 2120/10; F24F 2110/10
See application file for complete search history.

(56) References Cited

U.S. PATENT DOCUMENTS 6,150,943 A * 11/2000 Lehman ..... G08B 7/062 340/332
7,032,397 B1 4/2006 Mueller et al.
7,264,175 B2 9/2007 Schwendinger et al.
7,317,970 B2 * 1/2008 Pienta ..... G05D 23/1905 236/91 D (Continued)

*Primary Examiner* — Adnan Aziz
(74) *Attorney, Agent, or Firm* — Holland & Hart, LLP

(57) ABSTRACT

A device having indirect visual indicators to communicate information about states of operation is disclosed herein. The visual indicators may output a visual indication based on operational states of the device or other systems associated with the device. In some examples, a thermostat may include a downcast light that outputs a visual indication based on a mode of operation of the thermostat or a mode of operation of an associated heating, cooling, and ventilation (HVAC) system. Various characteristics of the visual indication may be altered to output different information. In some examples, a color of the visual indication may change based on the modes of operation or the visual indication may be pulsed based on the modes of operation.

20 Claims, 10 Drawing Sheets

(56) References Cited

U.S. PATENT DOCUMENTS 8,091,795 B1 1/2012 McLellan et al.
8,172,435 B2 * 5/2012 Spiro ..... F21V 23/04 362/391
8,510,255 B2 * 8/2013 Fadell ..... G05B 15/02 706/52
8,554,376 B1 * 10/2013 Matsuoka ..... F24F 11/30 700/276
9,459,018 B2 10/2016 Fadell et al.
9,477,239 B2 10/2016 Bergman et al.
2003/0136853 A1 * 7/2003 Morey ..... F23N 5/203 236/46 R
2005/0234597 A1 10/2005 Harrod et al.
2006/0016898 A1 1/2006 Ashworth
2007/0045430 A1 3/2007 Chapman et al.
2007/0045431 A1 * 3/2007 Chapman, Jr. ..... G05D 23/1934 236/46 C
2007/0045442 A1 3/2007 Chapman et al.
2007/0241261 A1 10/2007 Wendt
2008/0006709 A1 1/2008 Ashworth et al.
2008/0151458 A1 * 6/2008 Beland ..... G05D 23/1902 361/114
2009/0140056 A1 6/2009 Leen
2010/0014277 A1 * 1/2010 Delany ..... H01H 9/182 362/95
2010/0097212 A1 * 4/2010 Wingate ..... G01V 3/15 340/540
2012/0092183 A1 * 4/2012 Corbett ..... F21S 9/022 340/815.4
2013/0113284 A1 * 5/2013 Altonen ..... H05B 47/105 307/31
2013/0173064 A1 7/2013 Fadell et al.
2013/0345882 A1 * 12/2013 Dushane ..... G05B 15/02 700/276
2014/0184418 A1 7/2014 Maeda et al.
2014/0316581 A1 10/2014 Fadell et al.
2015/0096170 A1 * 4/2015 Mittleman ..... H04N 5/77 29/825
2015/0096876 A1 * 4/2015 Mittleman ..... H01H 11/00 200/341
2015/0100167 A1 4/2015 Sloo et al.
2015/0163945 A1 6/2015 Barton et al.
2015/0260387 A1 * 9/2015 Gamble ..... F21V 23/0471 362/157
2016/0131382 A1 * 5/2016 Rosen ..... F24F 11/30 700/278
2016/0306538 A1 * 10/2016 Yamamoto ..... G06F 3/04842
2016/0313041 A1 10/2016 Pham et al.
2016/0320022 A1 * 11/2016 Chen ..... F21S 8/026
2017/0268797 A1 9/2017 Mowris et al.
2018/0059520 A1 * 3/2018 Dubois ..... G03B 21/10
2018/0080669 A1 * 3/2018 Corcoran ..... F24F 11/30
2018/0106491 A1 * 4/2018 Abrishamkar ..... G05D 23/1905
2018/0168019 A1 * 6/2018 Baker ..... G06K 9/2081

* cited by examiner

200

300

500

700

800

900

THERMOSTAT WITH DOWNCAST LIGHT

CROSS REFERENCE

The present application is a continuation of U.S. patent application Ser. No. 15/424,232, filed Feb. 3, 2017, titled "THERMOSTAT WITH DOWNCAST LIGHT," and assigned to the assignee hereof, the disclosure of which is expressly incorporated herein in its entirety by this reference.

BACKGROUND

The present disclosure, for example, relates to security and/or automation systems, and more particularly to a thermostat with downcast light.

Security and automation systems are widely deployed to provide various types of communication and functional features such as monitoring, communication, notification, and/or others. These systems may be capable of supporting communication with a user through a communication connection or a system management action.

Security and automation systems may be used to control various aspects of a building or home. For example, security and automation systems may be used to control a security system of a building, the climate of the building, and various other systems associated with the building. A security and automation system may interact with network-enabled devices in a building, such as devices and appliances associated with the Internet-of-Things (IoT).

SUMMARY

A device having indirect visual indicators to communicate information about states of operation of a security and automation system is described herein. The visual indicators may output a visual indication based on operational states of the device or other systems associated with the device. In some examples, a thermostat may include a downcast light that outputs a visual indication based on a mode of operation of the thermostat or a mode of operation of an HVAC system. Various characteristics of the visual indication may be altered to output different information. In some examples, a color of the visual indication may change based on the modes of operation or the visual indication may be pulsed based on the modes of operation.

A method of indicating an operating mode of a device is described. The method may include identifying a mode of operation of the device configured to automatically control a heating, ventilation, or air conditioning (HVAC) system, outputting a visual indication having a color based at least in part on the identified mode of operation, determining that a climate control system associated with the mode of operation is actively working, and pulsing the visual indication to oscillate between a first output state and a second output state based at least in part on the device being in the mode of operation and the climate control system being active, the first output state being brighter than the second output state.

An apparatus for indicating an operating mode is described. The apparatus may include means for identifying a mode of operation of a device configured to automatically control a heating, ventilation, or air conditioning (HVAC) system, means for outputting a visual indication having a color based at least in part on the identified mode of operation, means for determining that a climate control system associated with the mode of operation is actively working, and means for pulsing the visual indication to oscillate between a first output state and a second output state based at least in part on the device being in the mode of operation and the climate control system being active, the first output state being brighter than the second output state.

Another apparatus for indicating an operating mode is described. The apparatus may include a processor, memory in electronic communication with the processor, and instructions stored in the memory. The instructions may be operable to cause the processor to identify a mode of operation of a device configured to automatically control a heating, ventilation, or air conditioning (HVAC) system, output a visual indication having a color based at least in part on the identified mode of operation, determine that a climate control system associated with the mode of operation is actively working, and pulse the visual indication to oscillate between a first output state and a second output state based at least in part on the device being in the mode of operation and the climate control system being active, the first output state being brighter than the second output state.

A non-transitory computer readable medium for indicating an operating mode of a device is described. The non-transitory computer-readable medium may include instructions operable to cause a processor to identify a mode of operation of the device configured to automatically control a heating, ventilation, or air conditioning (HVAC) system, output a visual indication having a color based at least in part on the identified mode of operation, determine that a climate control system associated with the mode of operation is actively working, and pulse the visual indication to oscillate between a first output state and a second output state based at least in part on the device being in the mode of operation and the climate control system being active, the first output state being brighter than the second output state.

Some examples of the method, apparatus, and non-transitory computer-readable medium described above may further include processes, features, means, or instructions for identifying the mode of operation as a heating mode, wherein the color of the visual indication may be orange based at least in part on the device being in the heating mode.

Some examples of the method, apparatus, and non-transitory computer-readable medium described above may further include processes, features, means, or instructions for identifying the mode of operation as a cooling mode, wherein the color of the visual indication may be blue based at least in part on the device being in the cooling mode.

Some examples of the method, apparatus, and non-transitory computer-readable medium described above may further include processes, features, means, or instructions for selecting the mode of operation based at least in part on a difference between a current temperature of a space associated with the device and a temperature set point.

Some examples of the method, apparatus, and non-transitory computer-readable medium described above may further include processes, features, means, or instructions for activating, by the device, a heating mode based at least in part on the current temperature being less than the temperature set point. Some examples of the method, apparatus, and non-transitory computer-readable medium described above may further include processes, features, means, or instructions for modifying the color of the visual indication to be orange.

Some examples of the method, apparatus, and non-transitory computer-readable medium described above may further include processes, features, means, or instructions for activating, by the device, a cooling mode based at least in part on the current temperature being more than the temperature set point. Some examples of the method, apparatus, and non-transitory computer-readable medium described above may further include processes, features, means, or instructions for modifying the color of the visual indication to be blue.

Some examples of the method, apparatus, and non-transitory computer-readable medium described above may further include processes, features, means, or instructions for determining a first brightness associated with the first output state and a second brightness associated with the second output state. Some examples of the method, apparatus, and non-transitory computer-readable medium described above may further include processes, features, means, or instructions for determining a flash rate associated with the pulsing of the visual indication, wherein the first brightness, the second brightness, and the flash rate may be based at least in part on a parameter of the device.

Some examples of the method, apparatus, and non-transitory computer-readable medium described above may further include processes, features, means, or instructions for detecting an occupancy parameter of a space associated with the device, wherein outputting the visual indication may be based at least in part on the occupancy parameter.

Some examples of the method, apparatus, and non-transitory computer-readable medium described above may further include processes, features, means, or instructions for determining a duration since the climate control system began actively working, wherein pulsing the visual indication may be based at least in part on the duration satisfying a time threshold.

Some examples of the method, apparatus, and non-transitory computer-readable medium described above may further include processes, features, means, or instructions for determining a duration since the visual indication began to be output. Some examples of the method, apparatus, and non-transitory computer-readable medium described above may further include processes, features, means, or instructions for ceasing to output the visual indication based at least in part on the duration satisfying a time threshold.

In some examples of the method, apparatus, and non-transitory computer-readable medium described above, the climate control system may be an air conditioning system or an evaporative cooling system or a heating system.

In one embodiment, a computing device may include a processor and memory configured to automatically control a heating, ventilation, or air conditioning (HVAC) system, a housing having a wall-facing side configured to mount to a wall, a user-facing side positioned opposite the wall-facing side, and a floor-facing side extending between the wall-facing side and the user-facing side, and a visual indicator positioned in the housing adjacent to the floor-facing side and configured to output a colored visual indication based at least in part on a mode of operation of the device, wherein the visual indicator projects the colored visual indication onto a portion of the wall below the floor-facing side of the housing.

In some examples of the computing device described above, the housing defines an axis extending orthogonal to the wall-facing side. In some examples of the computing device described above, the visual indicator defines a center beam axis indicative of a center point of the colored visual indication output by the visual indicator. In some examples of the computing device described above, the visual indicator may be positioned such that the center beam axis forms an acute angle with the axis.

In some examples of the computing device described above, the colored visual indication may be a beam formed by the visual indicator having a beam width in a first direction and a beam height in a second direction perpendicular to the first direction, wherein the beam width may be larger than the beam height.

In some examples of the computing device described above, the housing defines a first dimension in a first direction and a second dimension in a second direction orthogonal to the first direction. In some examples of the computing device described above, the colored visual indication defines a third dimension in the first direction and a fourth dimension in the second direction, the fourth dimension being less than the second dimension.

In some examples of the computing device described above, the colored visual indication extends downwardly away from a bottom edge of the housing.

Some examples of the computing device described above may also include a user interface configured to receive commands regarding a temperature set point and the mode of operation of the device.

Some examples of the computing device described above may also include a temperature sensor configured to identify a current temperature of a space associated with the device.

Some examples of the computing device described above may also include a communication system configured to communicate indication data with a security and automation system. In some examples of the computing device described above may also include a communication system configured to communicate indication data with a control panel of a security and automation system.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

Security and building automation systems may be used increasingly to control various aspects of a building. For example, security and building automation systems may be used to control a security system of a building, the climate of the building, and various other systems. A security and building automation system may interact with network-enabled devices in a building, such as devices and appliances associated with the Internet-of-Things (IoT). As the number of devices and procedures controlled by a security and building automation system increases, the amount of information a security and building automation system communicates with a user also increases. Visual indications are described herein that convey information about the status of various components of the security and building automation system in an efficient manner.

A device having indirect visual indicators to communicate information about states of operation is described herein. The visual indicators may output a visual indication based on operational states of the device or other systems associated with the device. In some examples, a thermostat may include a downcast light that outputs a visual indication based on a mode of operation of the thermostat or a mode of operation of an associated heating, cooling, and ventilation (HVAC) system. Various characteristics of the visual indication may be altered to output different information. In some examples, a color of the visual indication may change based on the modes of operation or the visual indication may be pulsed based on the modes of operation.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
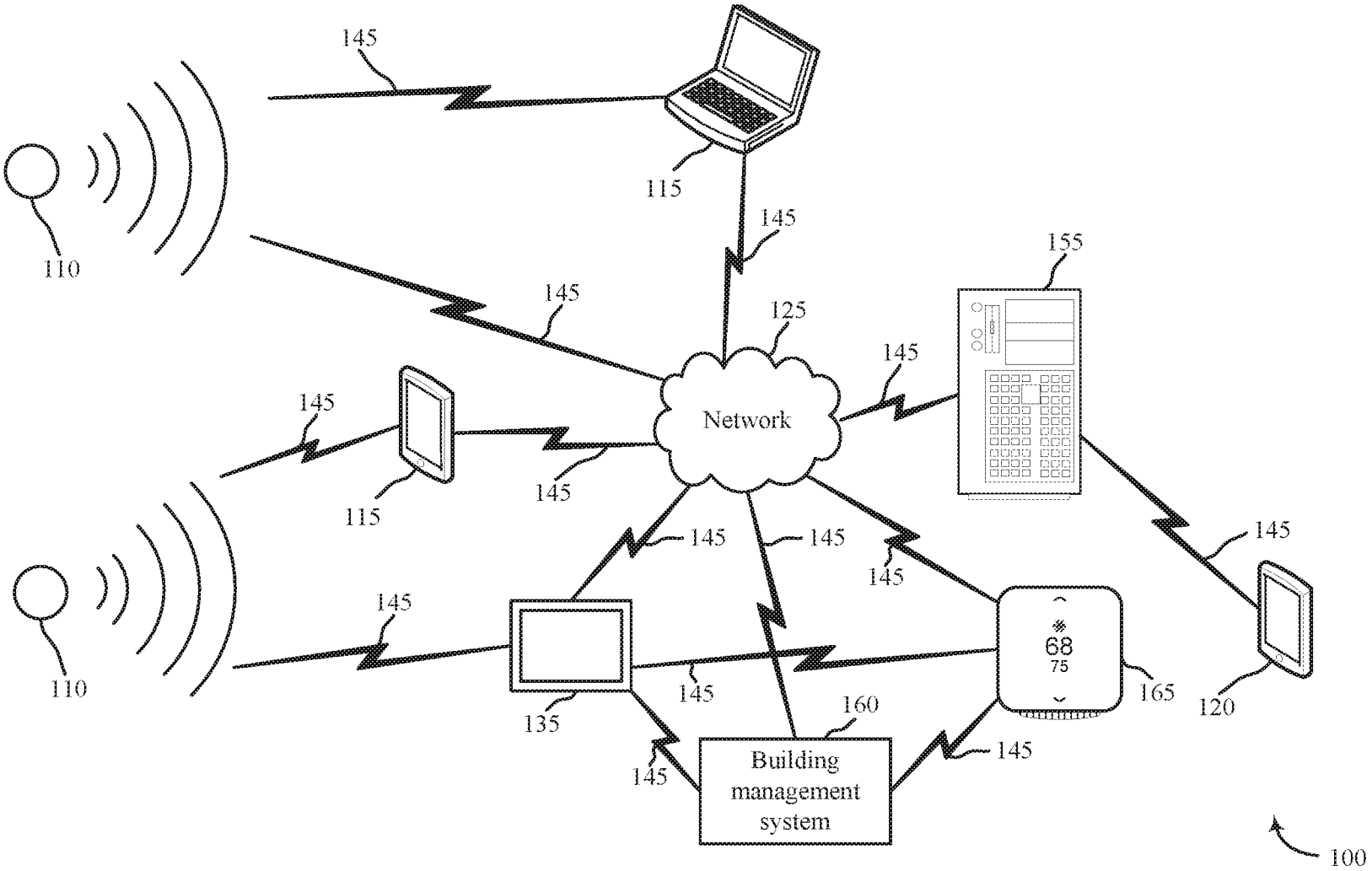
FIG. 1 illustrates an example of a system for indicating an operating mode of a device in accordance with aspects of the present disclosure.

FIG. 1 illustrates an example of a security and home automation system 100 in accordance with various aspects of the disclosure. In some embodiments, the security and home automation system 100 may include one or more sensor units 110, local computing devices 115, remote computing devices 120, network 125, control panel 135, remote computing device 120, server 155, building management systems 160, and a thermostat 165. One or more sensor units 110 may communicate via wired communication links or wireless communication links 145 with one or more of the local computing devices 115 or network 125. The network 125 may communicate via wired or wireless communication links 145 with the control panel 135 and the remote computing device 120 via server 155. In alternate embodiments, the network 125 may be integrated with any one of the local computing devices 115, server 155, or remote computing device 120, such that separate components are not required.

Local computing devices 115 and remote computing device 120 may be custom computing entities configured to interact with sensor units 110 via network 125, and in some embodiments, via server 155. In other embodiments, local computing devices 115 and remote computing device 120 may be general purpose computing entities such as a personal computing device, for example, a desktop computer, a laptop computer, a netbook, a tablet personal computer (PC), a control panel, an indicator panel, a multi-site dashboard, an iPod®, an iPad®, a smart phone, a mobile phone, a personal digital assistant (PDA), and/or any other suitable device operable to send and receive signals, store and retrieve data, and/or execute modules.

Control panel 135 may be a smart home system panel, for example, an interactive panel mounted on a wall in a user's home. Control panel 135 may be in direct communication via wired communication links or wireless communication links 145 with the one or more sensor units 110, or may receive sensor data from the one or more sensor units 110 via local computing devices 115 and network 125, or may receive data via remote computing device 120, server 155, building management systems 160, thermostat 165, and network 125.

The local computing devices 115 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110.

The processor of the local computing devices 115 may be operable to control operation of the output of the local computing devices 115. The output may be a television, a liquid crystal display (LCD) monitor, a cathode ray tube (CRT) monitor, speaker, tactile output device, and/or the like. In some embodiments, the output may be an integral component of the local computing devices 115. Similarly stated, the output may be directly coupled to the processor.

For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115 to the output.

The remote computing device 120 may be a computing entity operable to enable a remote user to monitor the output of the sensor units 110, to interact with the local computing devices 115, the control panel 135, the building management system 160, or the thermostat 165 to receive data related to the security and home automation system 100, and/or to issue commands related to the security and home automation system 100. The remote computing device 120 may be functionally and/or structurally similar to the local computing devices 115 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 120 may receive and/or send signals over the network 125 via wireless communication links 145 and server 155.

In some embodiments, the one or more sensor units 110 may be sensors configured to conduct periodic or ongoing automatic measurements related to temperature, occupancy of an edifice, operations of building management systems (e.g., an HVAC system). Each sensor unit 110 may be capable of sensing multiple temperature, occupancy, or operational parameters, or alternatively, separate sensor units 110 may monitor separate temperature, occupancy, and operational parameters. For example, one sensor unit 110 may measure a current temperature either interior to a building or exterior to the building, while another sensor unit 110 (or, in some embodiments, the same sensor unit 110) may detect occupancy of a building. In some embodiments, one or more sensor units 110 may additionally monitor alternate operational parameters, such as whether an air conditioning (A/C) unit is operating or whether a heater unit is operating. Sensor units 110 may monitor a variety of building management systems, such as the HVAC systems, and the like. In alternate embodiments, a user may input temperature, occupancy, or operational data directly at the local computing devices 115 at remote computing device 120, at the control panel 135, or at the thermostat 165. For example, a user may enter temperature set point data into a dedicated application on his or her smart phone indicating a desired temperature of an interior of a building.

Data gathered by the one or more sensor units 110 may be communicated to local computing devices 115, which may include, in some embodiments, a thermostat or other wall-mounted input/output smart home display. In other embodiments, local computing devices 115 may be a personal computer or smart phone. Where local computing devices 115 are a smart phone, the smart phone may have a dedicated application directed to collecting temperature, occupancy, or operational data and calculating various visual indications to output therefrom. The local computing devices 115 may process the data received from the one or more sensor units 110 to obtain visual indication parameters indicative of the visual indicator output by a controller. In alternate embodiments, remote computing device 120 may process the data received from the one or more sensor units 110, via network 125 and server 155, to obtain visual indication parameters indicative of the visual indicator output by a controller. Data transmission may occur via, for example, frequencies appropriate for a personal area network (such as BLUETOOTH® or IR communications) or local or wide area network frequencies such as radio frequencies specified by the Institute of Electrical and Electronics Engineers (IEEE) 802.15.4 standard.

In some embodiments, local computing devices 115 may communicate with remote computing device 120, control panel 135, or thermostat 165 via network 125 and server 155. Examples of networks 125 include cloud networks, LAN, WAN, virtual private networks (VPN), wireless networks (using 802.11, for example), and/or cellular networks (using 3G and/or LTE, for example), etc. In some configurations, the network 125 may include the Internet. In some embodiments, a user may access the functions of local computing devices 115 from remote computing device 120. For example, in some embodiments, remote computing device 120 may include a mobile application that interfaces with one or more functions of local computing devices 115.

The server 155 may be configured to communicate with the sensor units 110, the local computing devices 115, the remote computing device 120, the control panel 135, the building management systems 160, and the thermostat 165. The server 155 may perform additional processing on signals received from the sensor units 110 or local computing devices 115, or may simply forward the received information to the remote computing device 120, control panel 135, the building management systems 160, or the thermostat 165.

Server 155 may be a computing device operable to receive data streams (e.g., from sensor units 110 and/or local computing devices 115, remote computing device 120, control panel 135, or thermostat 165), store and/or process data, and/or transmit data and/or data summaries (e.g., to remote computing device 120, control panel 135, or thermostat 165). For example, server 155 may receive a stream of temperature, occupancy, or operational data from a sensor unit 110, a different stream of temperature, occupancy, or operational data from the same or a different sensor unit 110, and yet another stream of temperature, occupancy, or operational data from either the same or yet another sensor unit 110. In some embodiments, server 155 may "pull" the data streams, e.g., by querying the sensor units 110, the local computing devices 115, the control panel 135, and/or the thermostat 165. In some embodiments, the data streams may be "pushed" from the sensor units 110 and/or the local computing devices 115 to the server 155. For example, the sensor units 110 and/or the local computing devices 115 may be configured to transmit data as it is generated by or entered into that device. In some instances, the sensor units 110 and/or the local computing devices 115 may periodically transmit data (e.g., as a block of data or as one or more data points).

The server 155 may include a database (e.g., in memory) containing temperature, occupancy, or operational data received from the sensor units 110 and/or the local computing devices 115. Additionally, as described in further detail herein, software (e.g., stored in memory) may be executed on a processor of the server 155. Such software (executed on the processor) may be operable to cause the server 155 to monitor, process, summarize, present, and/or send a signal associated with resource usage data.

The building management systems 160 may include any computerized system used to manage one or more conditions present in a building or home. Examples of building management systems 160 may include a HVAC system, a security system, a lighting system, a fire suppression system, a power management system, an appliance control system, a door monitoring system including a doorbell camera, a lock control system, an irrigation control system, other types of systems or combinations thereof. Each building management system 160 may include a controller configured to communicate with the local computing devices 115, the remote computing devices 120, the control panel 135, the server 155, the thermostat 165, or combinations thereof. The controller of each building management system 160 may be configured to receive data from these various devices in security and home automation system 100. For example, a controller of a building management system 160 may receive commands to change operation of the building management system. The controller of each building management system 160 may be configured to transmit data to these various devices in security and home automation system 100. For example, a controller of the building management system 160 may transmit data indicative of how the building management system 160 is operating, sensor data related to the operations of the building management system 160, sensor data related to conditions related to the conditions affected by the building management systems 160, or combinations thereof.

In some examples, the building management system 160 may be an HVAC system. The HVAC system may include an A/C unit, a heater unit, a ventilation unit, a humidity unit, sensors, valves, or dampers. A controller for an HVAC system may be configured to communicate data with (e.g., transmit and receive) each of these units and to communicate data with the other components of the security and home automation system 100. For example, a controller for the HVAC system may be configured to control the climate in one or more zones of a building. A building, such as a home, may be divided into different zones. Each zone may have independent climate control. For example, a bedroom in a home may be kept at a different temperature and humidity from a kitchen of a home.

In some examples, the building management system 160 may be a security system. The security system may include cameras, motion sensors, lights sensors, pressure sensors, lock sensors, radio frequency communication signal detectors, audio sensors, temperature sensors, other occupancy sensors, alarm units, communication units, other systems, or combinations thereof. A controller for a security system may be configured to communicate data with (e.g., transmit and receive) each of these units and to communicate data with the other components of the security and home automation system 100. In some instances, the security system may be configured to determine whether a building is occupied by a human. In addition, the security system may be configured to determine an identity of an occupant. For example, motion sensors may be used to determine that an object or a being is moving in the building. Recognition algorithms (e.g., facial or object recognition algorithms) may be used on camera data to identify the moving object. In other instances, the security system may recognize a voice of an individual from audio data. In other instances, the security system may recognize a mobile computing device associated with an individual based on radio frequency (RF) communication signals detected in the building. For example, when an a smartphone or tablet is within range of a wireless access point (e.g., Wi-Fi, cellular, Bluetooth, or other networks), the smartphone or tablet may connect to the access point. The security system may recognize that certain mobile computing devices are associated with certain individuals.

In some examples, building management system 160 may be a lighting system, a power management system, an appliance management system, an irrigation system, or other type of system. In each of these examples, a controller may be configured to communicate data with (e.g., transmit and receive) the various subsystems and units of these systems and to communicate data with the other components of the security and home automation system 100. A lighting system may be used to control lights based on occupancy parameters or other data received from components of the security and home automation system 100. For example, certain lights be turned off or on when a building in unoccupied. Other systems may be controlled based on data received from components of the security and home automation system 100.

The thermostat 165 may be a device or system for regulating climate parameters (e.g., temperature or humidity) within at least a portion (e.g., a zone) of building. The thermostat 165 may be a computing entity operable to control an HVAC system for a building and monitor sensor data related to the operation of the HVAC system. In addition, the thermostat 165 may be configured to communicate data with the local computing devices 115, the remote computing devices 120, the control panel 135, the server 155, or the building management systems 160 via the network 125 and wireless communication links 145. In some examples, the thermostat 165 serves as a gateway device between an HVAC system (e.g., an example of a building management system 160) and the other components of a security and home automation system 100 (e.g., computing devices 115, 120, control panel 135, or server 155). In these examples, some or all communications between the HVAC system and the local computing devices 115, the remote computing devices 120, the control panel 135, or the server 155 are passed-through the thermostat 165. In some examples, the thermostat 165 is the controller of the HVAC system. In other examples, the control panel 135 may serve as the gateway device between the HVAC system and the other components of a security and home automation system 100. It should be appreciated that the control panel 135 or other computing device may serve as a gateway device for other building management systems, in some examples.

Figure 2:
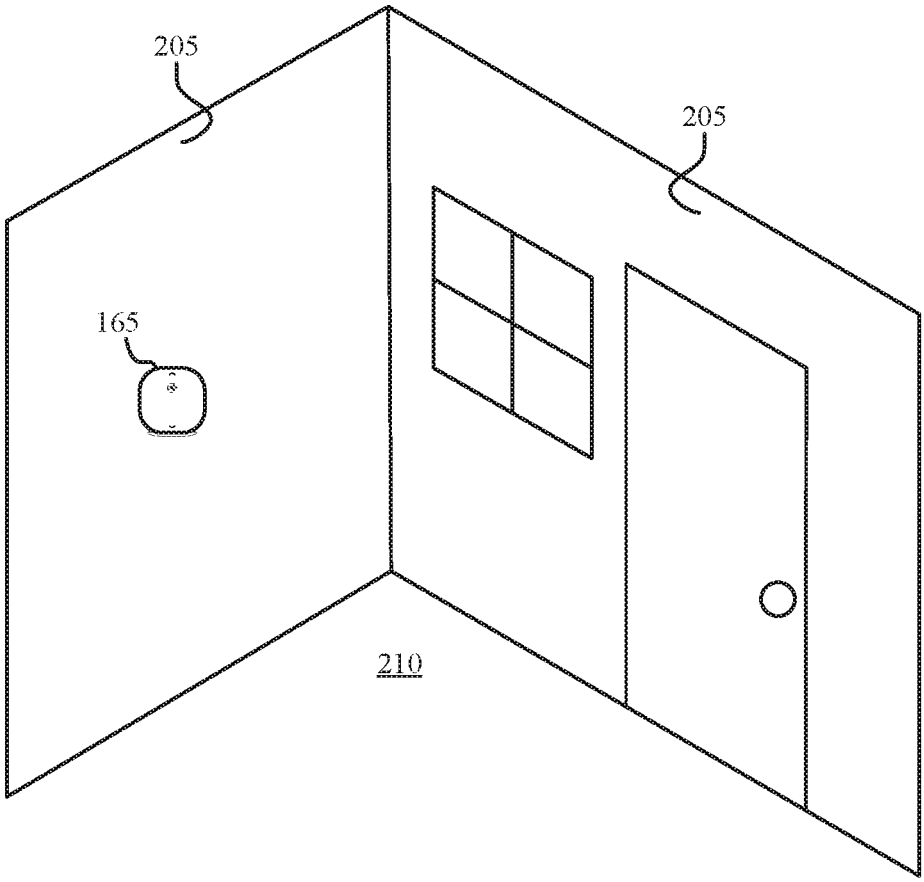
FIG. 2 illustrates an example of an environment that supports a thermostat with downcast light in accordance with aspects of the present disclosure.

FIG. 2 illustrates an example of an environment 200 for the thermostat 165. The thermostat 165 may be a wall-mounted thermostat configured to be placed on a wall 205 of building or a room. The thermostat 165 may be positioned a distance above a floor 210. In some examples, the control panel 135 is a wall-mounted computing device positioned on the wall 205.

Figure 3:
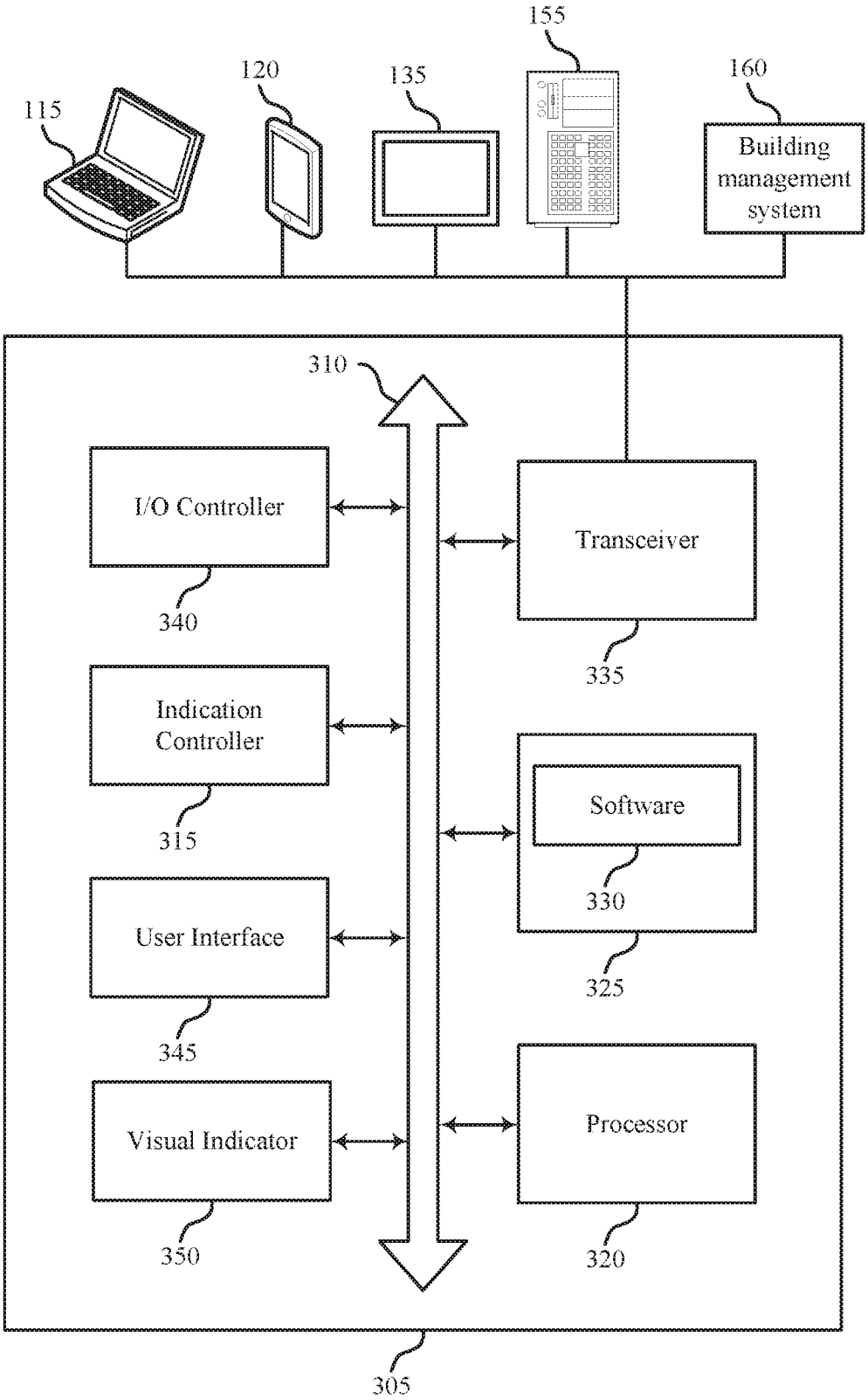
FIG. 3 illustrates an example of a system that includes a thermostat with downcast light in accordance with aspects of the present disclosure.

FIG. 3 shows a diagram of a system 300 including a device 305 that supports a thermostat with downcast light in accordance with various aspects of the present disclosure. Device 305 may be an example of or include the components of thermostat 165, device 705, or device 805, as described, e.g., with reference to FIGS. 1, 7 and 8. Device 305 may include components for bi-directional voice and data communications including components for transmitting and receiving communications, including indication controller 315, processor 320, memory 325, software 330, transceiver 335, I/O controller 340, user interface 345, and a visual indicator 350. These components may be in electronic communication via one or more busses (e.g., bus 310). In some examples, device 305 may be an example of a control panel 135 or some other gateway device that interacts with a building management system 160.

In some cases, device 305 may communicate with a remote storage device, and/or a remote server (e.g., server 155). For example, one or more elements of device 305 may provide a direct connection to a remote server via a direct network link to the Internet via a POP (point of presence). In some embodiments, one element of device 305 (e.g., one or more antennas, transceivers, etc.) may provide a connection using wireless techniques, including digital cellular telephone connection, Cellular Digital Packet Data (CDPD) connection, digital satellite data connection, and/or another connection.

Many other devices and/or subsystems may be connected to one or may be included as one or more elements of system 300 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 3 need not be present to practice the present systems and methods. The devices and subsystems may also be interconnected in different ways from that shown in FIG. 3. In some embodiments, an aspect of the operations of system 300 may be readily known in the art and are not discussed in detail in this disclosure.

The signals associated with system 300 may include wireless communication signals such as radio frequency, electromagnetics, LAN, WAN, VPN, wireless network (using 802.11, for example), 345 MHz, Z-WAVE®, cellular network (using 3G and/or Long Term Evolution (LTE), for example), and/or other signals. The radio access technology (RAT) of system 300 may be related to, but are not limited to, wireless wide area network (WWAN) (GSM, CDMA, and WCDMA), wireless local area network (WLAN) (including BLUETOOTH® and Wi-Fi), WiMAX, antennas for mobile communications, antennas for Wireless Personal Area Network (WPAN) applications (including radio frequency identification devices (RFID) and UWB). In some embodiments, one or more sensors (e.g., motion, proximity, smoke, light, glass break, door, window, carbon monoxide, and/or another sensor) may connect to some element of system 300 via a network using the one or more wired and/or wireless connections.

Processor 320 may include an intelligent hardware device, (e.g., a general-purpose processor, a DSP, a central processing unit (CPU), a microcontroller, an ASIC, an FPGA, a programmable logic device, a discrete gate or transistor logic component, a discrete hardware component, or any combination thereof). In some cases, processor 320 may be configured to operate a memory array using a memory controller. In other cases, a memory controller may be integrated into processor 320. Processor 320 may be configured to execute computer-readable instructions stored in a memory to perform various functions (e.g., functions or tasks supporting a thermostat with downcast light).

Memory 325 may include RAM and ROM. The memory 325 may store computer-readable, computer-executable software 330 including instructions that, when executed, cause the processor to perform various functions described herein. In some cases, the memory 325 may contain, among other things, a basic input/output system (BIOS) which may control basic hardware and/or software operation such as the interaction with peripheral components or devices.

Software 330 may include code to implement aspects of the present disclosure, including code to support a thermostat with downcast light. Software 330 may be stored in a non-transitory computer-readable medium such as system memory or other memory. In some cases, the software 330 may not be directly executable by the processor but may cause a computer (e.g., when compiled and executed) to perform functions described herein.

Transceiver 335 may communicate bi-directionally, via one or more antennas, wired, or wireless links as described above. For example, the transceiver 335 may represent a wireless transceiver and may communicate bi-directionally with another wireless transceiver. The transceiver 335 may also include a modem to modulate the packets and provide the modulated packets to the antennas for transmission, and to demodulate packets received from the antennas. The transceiver 335 may communicate bi-directionally with the local computing devices 115, the remote computing devices 120, the control panel 135, the server 155, one or more building management systems 160, or combinations thereof.

I/O controller 340 may manage input and output signals for device 305. I/O controller 340 may also manage peripherals not integrated into device 305. In some cases, I/O controller 340 may represent a physical connection or port to an external peripheral. In some cases, I/O controller 340 may utilize an operating system such as iOS®, ANDROID®, MS-DOS®, MS-WINDOWS®, OS/2®, UNIX®, LINUX®, or another known operating system. In other cases, I/O controller 340 may represent or interact with a modem, a keyboard, a mouse, a touchscreen, or a similar device. In some cases, I/O controller 340 may be implemented as part of a processor. In some cases, a user may interact with device 305 via I/O controller 340 or via hardware components controlled by I/O controller 340.

User interface 345 may enable a user to interact with device 305. In some embodiments, the user interface 345 may include an audio device, such as an external speaker system, an external display device such as a display screen, and/or an input device (e.g., remote control device interfaced with the user interface 345 directly and/or through the I/O controller module).

Visual indicator 350 may output a visual indication based on operations of the device 305 and its associated building management systems 160. The visual indicator 350 may be a downcast visual indicator positioned to direct light towards downwardly. For example, when the visual indicator 350 is part of a wall-mounted computing device such as thermostat 165, the visual indicator 350 may direct light in the general direction of the floor 210. The visual indicator 350 may include different types of lights such as, for example, a light emitting diode (LED), a compact fluorescent (CFL), an incandescent bulb, a fluorescent bulb, a halogen bulb, a chip-on-board (COB) LED, or various combinations thereof. The visual indicator 350 may receive commands from the processor 320 and may transmit operation data to the processor 320. In some instances, the downcast light may be another form of indirect lighting. As used herein, an indirect visual indication may refer to a visual indication that is reflected in some way prior to being observed by a user. For example, in a downcast light, the visual indicator 350 may be positioned such that a user may generally not observe direct beams of light emitted from the visual indicator 350. Rather, the user generally observes light from the visual indicator 350 after it is reflected off another object, such the wall 205. In some examples, the visual indicator 350 may be positioned such that the visual indication is reflected off of the wall 205 or the housing of the device 305 prior to being observed by a user.

Figure 4A:
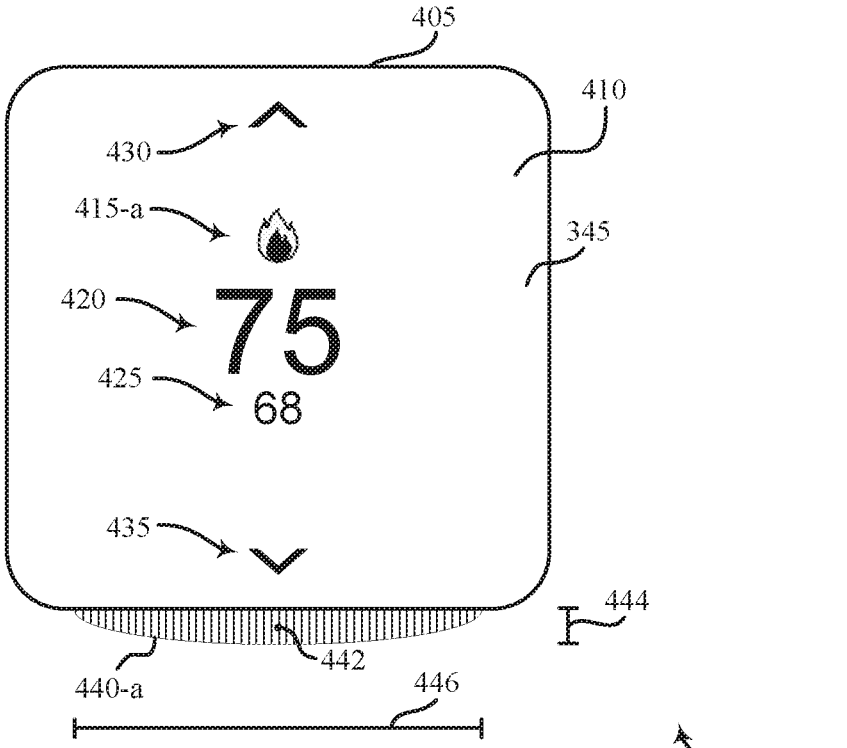
FIGS. 4A and 4B illustrate examples of a front elevation view of the thermostat of FIG. 3 in accordance with aspects of the present disclosure.

FIG. 4A illustrates an example of a thermostat 400. The thermostat 400 may be an example of the thermostat 165 operating in a first mode. FIG. 4A is a front elevation view of the thermostat 400 having a housing 405 and a user facing side 410. The user interface 345 is positioned on the user facing side 410 and outputs graphical elements to the user to indicate different functions, including text and images.

The graphical elements of the user interface 345 may include a mode indicator 415-*a*, a temperature set point indicator 420, a current temperature indicator 425, user inputs 430, 435, and a visual indication 440-*a*. The mode indicator 415-*a* may communicate a mode of operation of the thermostat 400 and/or the HVAC system associated with the thermostat 400. For example, mode indicator 415-*a* may show a symbol of a flame indicating that the thermostat 400 is operating in a heating mode. Other modes of operation may include a cooling mode, a ventilation mode, a humidifier mode, other climate control modes, or combinations thereof.

The temperature set point indicator 420 may indicate a temperature set point of the thermostat 400. The temperature set point may be determined based on user inputs received at the thermostat 400 (e.g., via user inputs 430, 435) or may be determined based on user inputs received from a remote computing device (e.g., local computing devices 115, remote computing devices 120, control panel 135, server 155, or various combinations thereof).

The current temperature indicator 425 may indicate a current temperature of a space in a building. The current temperature may be based on sensor data collected in the building. For example, the thermostat 400 may include a temperature sensor configured to determine the current temperature. In some instances, the current temperature may be based on sensor data received from sensors positioned in other locations throughout the building or outside of the building. For example, sensors 110 may measure the current temperature at various locations in a building and communicate that temperature data to the thermostat 400.

The user inputs 430, 435 may allow a user to modify characteristics and features of the thermostat 400. For example, user input 430 may be configured to allow a user to increase the temperature set point. In another examples, user input 435 may be configured to allow a user to decrease the temperature set point. In some examples, the user inputs 430, 435 may be used—either alone or with other user inputs—to modify other settings of the thermostat 400. The thermostat 400 may include other user inputs.

The visual indication 440-*a* may include a beam of light output by the visual indicator (e.g., visual indicator 350) The visual indication 440-*a* may be a downcast light that is projected onto a wall 205 in the direction of the floor 210, when the thermostat 400 is mounted on the wall 205. The visual indication 440-*a* may include a number of characteristics, such as color, brightness, flash rate, periodicity, a flash pattern, length of time of outputting, or combinations thereof. In some instances, the thermostat 400 may modify one of the characteristics of the visual indication 440-*a* based on temperature data, occupancy data, operational data, or combinations thereof. For example, if the thermostat 400 is operating in a heating mode, the visual indication 440-*a* may be a red, orange, pink, red-pink, or red-orange color. In other examples, if an HVAC system associated with the thermostat 400 is operating, the thermostat 400 may alter other characteristics of the visual indication 440-*a* such as, for example, a flash rate, a flash pattern, various brightness associated with flashing, color, periodicity, transitions between output states, other characteristics described herein, or combinations thereof. The visual indication 440-*a* may include any number of colors including, for example, white, gray, black, magenta, pink, red, brown, orange, yellow, green, cyan, blue, violet, or combinations thereof.

The visual indication 440-*a* may also include a beam center point 442, a vertical beam width 444, and a horizontal beam width 446. A beam width may refer to an angle or a distance at which the luminous intensity (e.g., candela) of the visual indication 440-*a* falls below an intensity threshold (e.g., 50%) when compared to the luminous intensity at the beam center point 442. In some examples, a beam width may be expressed as a beam angle that indicates an angle at which light is distributed or emitted from its source (e.g., visual indicator 350).

In some examples, the horizontal beam width 446 may be greater than the vertical beam width 444. In some examples, the horizontal beam width 446 may be equal to a width of the housing 405 of the thermostat 400. In some examples, the horizontal beam width 446 may be slightly less than a width of the housing 405 of the thermostat 400.

Figure 4B:
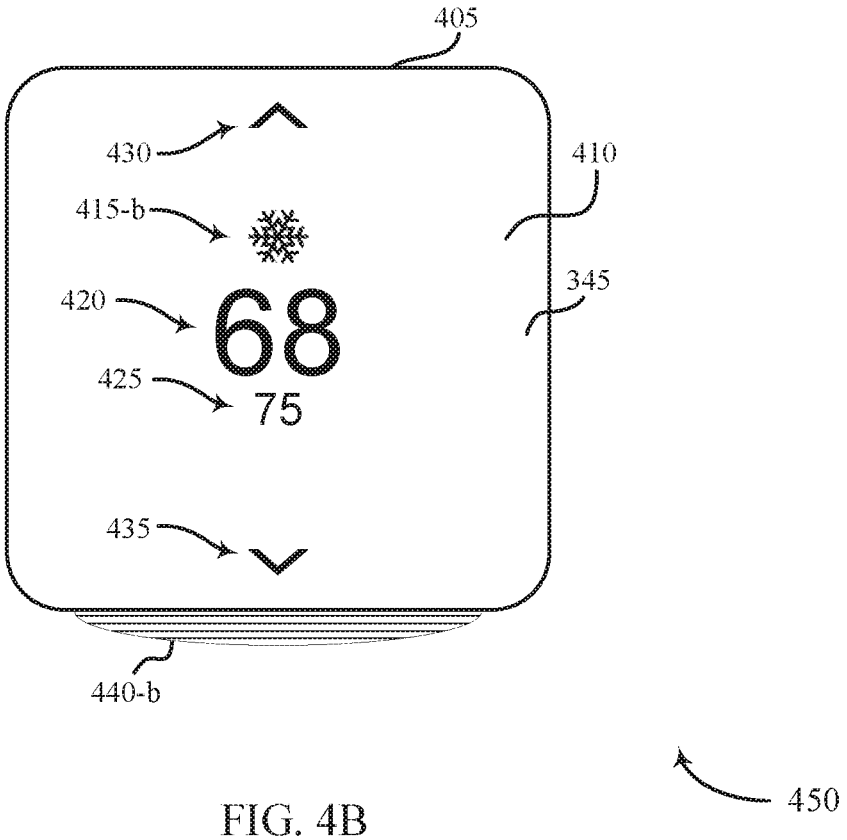

FIG. 4B illustrates an example of a thermostat 450. The thermostat 450 may be an example of the thermostat 165 operating in a second mode different from the first mode. FIG. 4B is a front elevation view of the thermostat 450 having a housing 405 and a user facing side 410. Other features of the thermostat 450 are similar to those of thermostat 400 described with reference to FIG. 4A. Notable differences between thermostat 400 and thermostat 450 include the mode indicator 415-*b* and the visual indication 440-*b*. The mode indicator 415-*b* of thermostat 450 shows a symbol of a snowflake indicating that the thermostat 450 is operating in a cooling mode. The visual indication 440-*b* may have different characteristics than visual indication 440-*a*. For example, the color of visual indication 440-*b* may be blue to indicate that the thermostat 450 is operating in a cooling mode. Other characteristics of the visual indication 440-*b* may be different from the visual indication 440-*a*.

Figure 5:
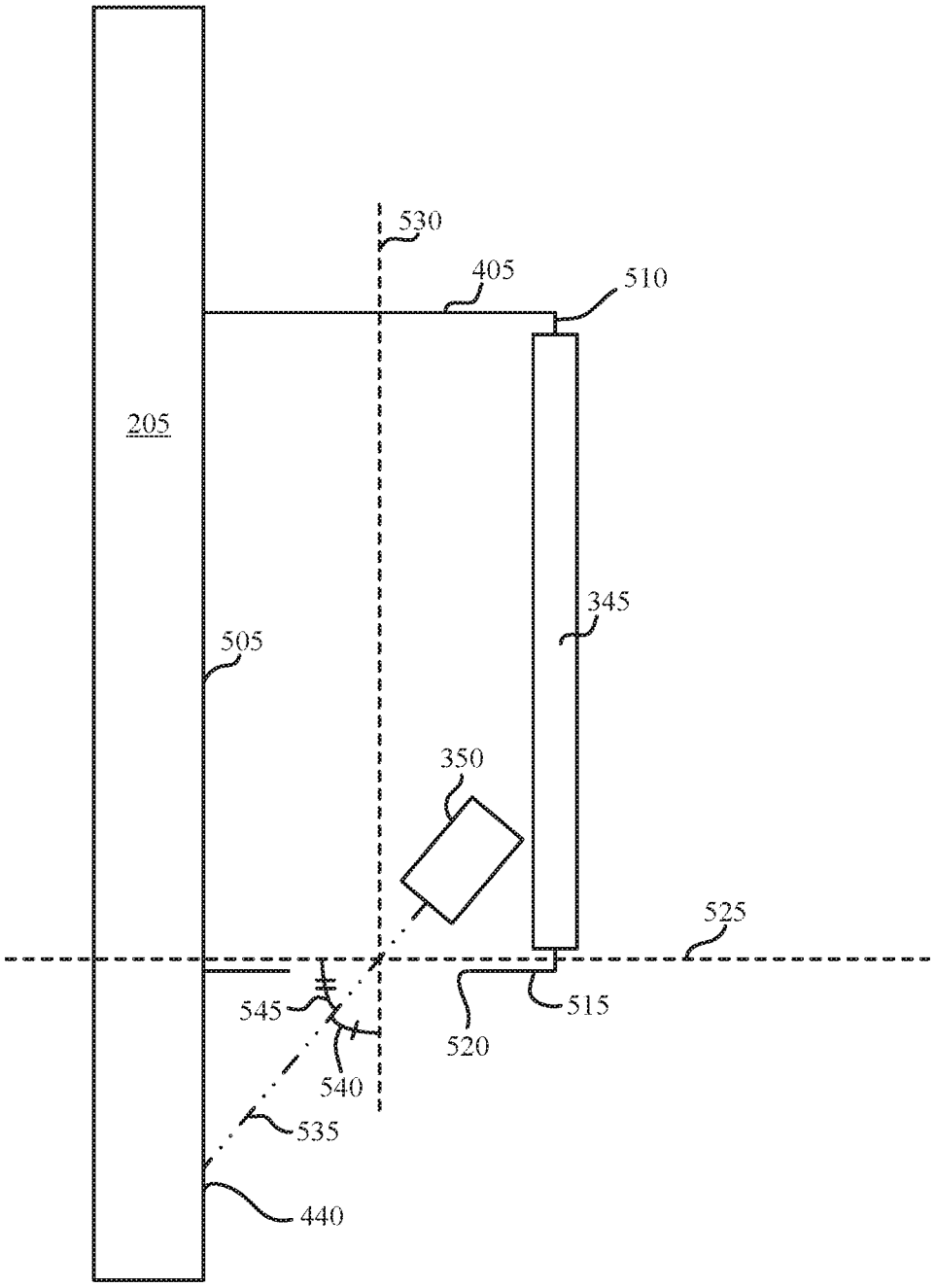
FIG. 5 illustrates an example of a side elevation view of the thermostat of FIG. 3 in accordance with aspects of the present disclosure.

FIG. 5 illustrates an example of a thermostat 500. The thermostat 500 may be an example of the thermostat 165, thermostat 400, or thermostat 450 described with reference to FIGS. 1, 4A, and 4B. FIG. 5 is a side elevation view of the thermostat 500. Portions of the thermostat are removed for clarity. The thermostat 500 shows a positioning of the visual indicator 350 in the thermostat 500 during operation.

The thermostat 500 may include a housing 405 having a wall-facing side 505, a user-facing side 510, and a floor-facing side 515. The thermostat 500 may be mounted to the wall 205 such that a surface of the wall-facing side 505 contacts and/or is secured to the wall 205 and the floor-facing side 515 is pointed toward the floor 210. The user-facing side 510 may include the user interface 345. An aperture 520 may be formed in the floor-facing side 515. The aperture 520 may be defined by a number of surfaces that extend through a wall of the housing 405. The aperture 520 may be configured to allow light generated by the visual indicator 350 to exit an interior portion of the housing 405 and project the visual indication 440 on a surface of the wall 205. The thermostat 500 may define a first axis 525 extending orthogonal to a side of the wall 205. The thermostat may also define a second axis 530 extending parallel to the side of the wall 205. In some examples, the visual indicator 350 may be positioned within an interior of the housing 405 such that direct rays output from the visual indicator 350 are obscured from being observed by a user.

The visual indicator 350 may be positioned within an interior portion of the housing 405. The visual indicator 350 may define a center beam axis 535 extending from the visual indicator 350 to the beam center point 442 of the visual indication 440. The visual indicator 350 may be positioned such that the center beam axis 535 may form a first angle 540 with the first axis 525 and a second angle 545 with the second axis 530. In some examples, the visual indicator 350 may be positioned such that the first angle 540 is zero degrees and the second angle 545 is ninety degrees (i.e., the visual indicator 350 is pointed at the floor 210). In some examples, the visual indicator 350 may be positioned such that the first angle 540 is ninety degrees and the second angle 545 is zero degrees (i.e., the visual indicator 350 is pointed at the wall 205). In some examples, both the first angle 540 and the second angle 545 are non-zero values. The visual indicator 350 may be positioned such that a beam of light pass through the aperture 520.

The housing 405 and the visual indicator 350 may be configured similarly in other devices as well. For example, a control panel 135 may be include the visual indicator 350 and the housing 405 discussed. In such examples, the visual indicator 350 may be positioned in in the housing 405 in a similar manner as described herein.

Figure 6:
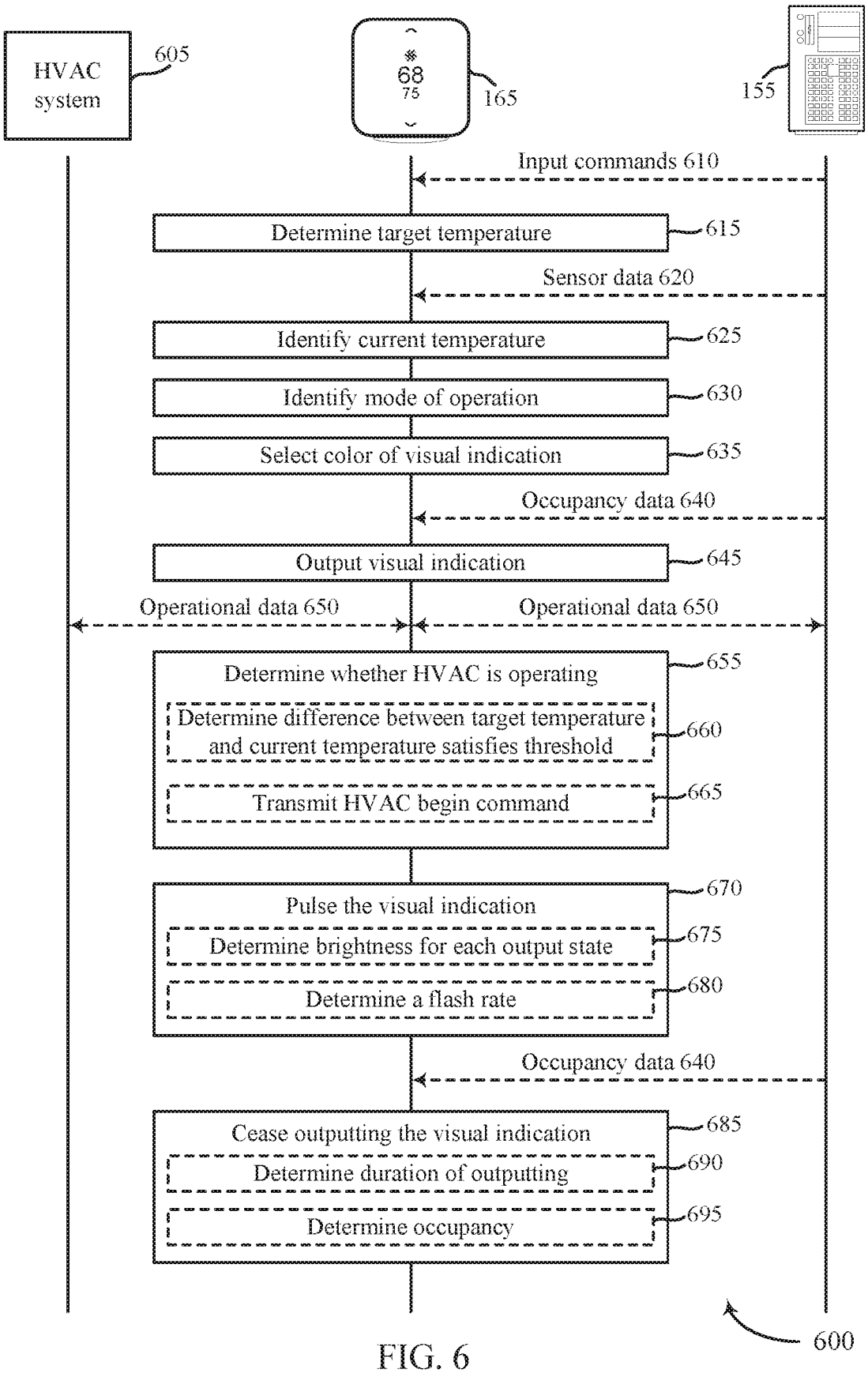
FIG. 6 illustrates an example of a communication scheme that supports a thermostat with downcast light in accordance with aspects of the present disclosure.

FIG. 6 illustrates an example of a communication scheme 600 that supports communications for a thermostat with downcast light. The communication scheme 600 illustrates procedures and communications implemented by an HVAC system 605, the thermostat 165, and the server 155. The communication scheme 600 may be configured to facilitate the outputting of a downcast visual indication by the thermostat 165.

In some instances, the HVAC system 605 may be any type of building management system 160 described herein. In some instances, the thermostat 165 may be a different type of controller or computing device such as, for example, the control panel 135, the local computing devices 115, the remote computing devices 120, the server 155, or combinations thereof. In some instances, the server 155 may be any of the devices in the security and home automation system 100 that communicate with the controller. For example, the server 155 may be the control panel 135, the local computing devices 115, or the remote computing devices 120 in other instances of the communication scheme 600. In some examples, various individual units of the HVAC system 605 may be referred to as a climate control systems.

The thermostat 165 may receive input commands 610 from the server 155. In other examples, input commands 610 may be received directly by the thermostat 165 via the user interface 345. The input commands 610 may include commands issued by a user to alter the operation of the thermostat 165 or the HVAC system 605 in some manner. For example, the input commands 610 may include data indicating a target temperature, indicating a mode of operation (e.g., heating, cooling, ventilation, humidify), indicating an output mode (e.g., what indications are output to a user, or other types of input commands. Input commands 610 may include commands that are specific for individual climate control zones of a building. A user may generate input commands 610 using the thermostat 165 directly, a local computing device 115, a remote computing device 120, a control panel 135, or other computing device. In situations where the input commands 610 are generated remotely from the thermostat 165, the input commands 610 may be communicated via the network 125 to the thermostat 165. In some examples, the server 155 receives input commands 610 from other devices and transmits the input commands 610 to the thermostat 165. In some examples, the other devices (e.g., computing devices 115, 120 or control panel 135) may communicate the input commands 610 directly to the thermostat 165.

In some instances, the input commands 610 may include a set of criterion for operating the thermostat 165 and the HVAC system 605. For example, the input commands 610 may include rules for target climate control based on the time of day, the day of the week, occupancy parameters, the calendar date, the time of year, or other factors.

At block 615, the thermostat 165 may determine a target temperature based on the input commands 610. The thermostat 165 may dynamically determine a target temperature based on criterion and other factors included in the input commands. For example, the thermostat 165 may identify when an individual enters the home and alter the target temperature accordingly. In some instances, the separate target temperatures may be associated with specific individuals. In some examples, the thermostat 165 may determine the target temperature based on specific information included in the input commands 610. For example, the input commands 610 may specify that the temperature set point should be a specific temperature (e.g., 70 degrees Fahrenheit).

The thermostat 165 may receive sensor data 620 from the server 155. In other examples, sensor data 620 may be generated locally by sensors integrated into the thermostat 165 (e.g., temperature sensors). The sensor data 620 may include various types of climate data including temperature data, barometric data, humidity data. The sensor data 620 may be generated by sensors 110 and communicated to the thermostat 165 via the network 125 and/or the server 155. The sensor data 620 may include climate data for the interior of the building, the exterior of the building, various individual zones of the building, or combinations thereof.

At block 625, the thermostat 165 may identify a current temperature based on the sensor data 620. The current temperature may be for the entire building or for a single zone of a building. The thermostat 165 may output the current temperature via the user interface 345.

At block 630, the thermostat 165 may identify a mode of operation for the thermostat 165 and/or a mode of operation for the HVAC system 605. The modes of operation for the thermostat 165 may include a cooling mode, a heating mode, a ventilation mode, an unoccupied mode, a calendar schedule mode, a humidifier mode, or combinations thereof. The cooling mode may include operation of an A/C unit or a swamp cooler of the HVAC system 605. The heating may include operation of a heating unit of the HVAC system 605. A ventilation mode may include operation of one or more fans of the HVAC system 605. The unoccupied mode may include a temporary change in climate conditions for the building based on the building being unoccupied for a predetermined amount of time. A calendar schedule mode may include operating the HVAC system 605 according to a calendar and a schedule. For example, the target temperature may be set at a first value between the hours of 9 am and 5 pm when the occupants of a home are at work and may be set at a second value at other times when the occupants are more likely to be home. A humidifier mode may include operation of a humidifier of the HVAC system 605. It should be appreciated that at least some of these modes may be used in combinations.

In some instances, the thermostat 165 may determine the mode of operation based on the input commands 610. For example, the input commands 610 may specify that the thermostat 165 and the HVAC system 605 is in a cooling mode, regardless of the target temperature or the current temperature. In some instances, the thermostat 165 may determine the mode of operation dynamically. For example, the thermostat 165 may determine its mode of operation based on differences between the current temperature and the target temperature. For examples, the thermostat 165 may compare the current temperature to the target temperature to determine a difference between the two values. If the difference between target temperature and the current temperature satisfies a temperature threshold, the thermostat 165 may activate a certain mode of operation. For example, if the temperature threshold is three degrees, if the current temperature is four degrees higher than the target temperature, the thermostat 165 may activate a cooling mode.

At block 635, the thermostat 165 may select one or more characteristics of a visual indication output by the thermostat 165. The visual indication may be a downcast light projected below the thermostat 165. The thermostat 165 may select a color of the visual indication based on the mode of operation of the thermostat 165. For example, if the thermostat 165 is in a cooling mode, the thermostat 165 may select the color of the visual indication to be blue. In other examples, if the thermostat 165 is in a heating mode, the thermostat 165 may select the color of the visual indication to be red, pink, orange, red-pink, or red-orange. Other colors may be associated with other modes of operation. For example, the color green may be associated with an unoccupied mode.

The thermostat 165 may receive occupancy data 640 from the server 155. In other examples, occupancy data 640 may be generated locally by sensors integrated into the thermostat 165 (e.g., motion sensors). If no one is occupied the space or the building associated with the thermostat 165, the thermostat 165 may determine to not output a visual indication. Consequently, in some examples, the thermostat 165 may determine the occupancy of the building prior to outputting the visual indication. Occupancy data 640 may include data indicative that any individual or entity is in the building. In some examples, occupancy data 640 may include data about whether specific individuals are in a building or a space. For example, occupancy data 640 may indicate that a specific individual is in the building or space. In some instances, the thermostat 165 may modify climate conditions and/or the modes of operation of the thermostat 165 based on the specific individual being present.

Occupancy data 640 may be generated by one or more of the building management systems 160 such as, for example, a security system. Occupancy data 640 may be based at least in part on sensor data received from one or more sensors 110 in the building. Types of sensor data used to generate occupancy data may be camera data, motion sensor data, light detector data, audio data, RF communication signal data, or various combinations thereof. A computing device of the security and home automation system 100 may take the sensor data and generate occupancy data 640 based on rules applied thereto. For example, occupancy data 640 may include an indication that a human being is active in the building, rather than a dog being active in the building. In some examples, an occupancy parameter is generated based on the occupancy data 640. In other examples, the occupancy data 640 includes an occupancy parameter.

At block 645, the thermostat 165 may output the visual indication. Outputting the visual indication may be based on occupancy data 640 in some instances. In other instances, however, the thermostat 165 may output the visual indication regardless of occupancy. In addition, functions of block 645 may be implemented any time a characteristic of the visual indication is modified or changed. In examples, the visual indication may cease to be output, but after a change in operation of the thermostat 165 or the HVAC system 605, the visual indication may be output again. As such, the functions at block 645 may be implemented in many different locations of the communication scheme 600.

The thermostat 165 may communicate operational data 650 with the HVAC system 605 or the server 155. Operational data 650 may include information related to how any of the devices in the communication are functioning or operating at the time. Examples of operational data 650 may include indicating which unit of the HVAC system 605 is operating, the functioning status of the units of the HVAC system 605, maintenance status of the units of the HVAC system 605, resources levels of various consumable resources associated with the HVAC system 605 (e.g., an A/C unit may require additional coolant to operate more efficiently), the mode of operation of the thermostat 165, the current temperature, the target temperature, remote commands received from the server 155, data indicating which user issued a remote command, or various combinations thereof. In some examples, the thermostat 165 and/or the HVAC system 605 may transmit operational data 650 (including sensor data such as temperature data) to the server 155 at regular intervals. In some examples, the thermostat 165 and/or the HVAC system 605 may transmit operational data 650 (including sensor data such as temperature data) to the server 155 upon a request received from one of the computing devices of the security and home automation system 100.

Operational data 650 may also include messages that are requests for additional data. For example, the thermostat 165 may request information from the HVAC system 605 about whether a unit of the HVAC system is currently operating. Operational data 650 may include both the request the response to the request. Response to such a request may include an acknowledgement (ACK), a negative acknowledgement (NACK), or simply transmitting the requested information. In the communication scheme 600, any entity (e.g., HVAC system 605, thermostat 165, or server 155) may request information or may respond to requests for information.

At block 655, the thermostat 165 may determine whether a unit of the HVAC system 605 is operating actively. Such a determination may be based on operational data received from the HVAC system 605 by the thermostat 165. In some instances, the thermostat 165 may determine whether the HVAC is operating based on sensor data received from sensors 110. For example, sensors 110 may detect that air is flowing through a vent. Based on such sensor data, the thermostat 165 may determine that at least a ventilation system/fan of the HVAC system 605 is operating at the moment.

In some examples, the thermostat 165 may determine whether a unit of the HVAC system 605 is operating based on commands issued by the thermostat 165. At block 660, the thermostat 165 may determine that a difference between the target temperature and the current temperature satisfies a threshold. At block 665, the thermostat 165 may generate and transmit a command to the HVAC system 605 to begin operation. The command may be based on what mode of operation the thermostat 165 is in. For example, if the thermostat 165 is in a cooling mode and the difference between the current temperature and the target temperature indicates that the heater should be run, the thermostat 165 may not issue a begin command. In some examples, the thermostat 165 may dynamically adjusted its mode of operation based on the differences between the current temperature and the target temperature. The thermostat 165 may determine that the HVAC system 605 is currently operating based on transmitting the command. Similarly, the thermostat 165 may also transmit cease commands based on the differences between current temperatures and target temperatures. Such cease commands may also be used by the thermostat 165 to determine whether the HVAC system 605 is actively operating.

At block 670, the thermostat 165 may alter one or more characteristics of one or more output states of the visual indication. In some examples, altering the features of the output states may be based on the HVAC system 605 currently operating. In some examples, the thermostat 165 may pulse the visual indication based on determining that the HVAC system is currently operating. Pulsing the visual indication may refer to a flashing light. To generate the pulsing, the thermostat 165 may determine two or more output states. In some examples of a pulsing visual indication, a first output state may be a turned off state and a second output state may be a turned on state. The thermostat 165 may determine characteristics for each output state in the visual indication and transitions between the output states. Characteristics of an output state may include a brightness level of the output state, a length of time of the rate, other characteristics described herein, or combinations thereof. Characteristics of a transition between output states may include a length of time of the transition, how gradual or abrupt the transition is, other characteristics of the transition, or combinations thereof. In some examples, a transition may specify that a first end of the visual indication transitions prior to a second end of the visual indication transitioning. The thermometer may also determine characteristics of the entire visual indication display such as for example, a pattern of output states, a periodicity for the entire display In some examples, at block 670, the thermostat 165 may determine a brightness level for each output state of the visual indication. The brightness level may change based on the time of day. For example, at night, the brightness level for each output state may be less than a brightness level for each output state during the day. At block 680, the thermostat 165 may determine a flash rate for a pulsing visual indication. The flash rate may refer to how frequently the visual indication oscillates between output states. For example, if a pulsing indication has two output states, on and off, the flash rate may indicate that the on-state occurs one per second.

At block 685, the thermostat 165 may cease outputting the visual indication based on a variety of factors. Ceasing to output the visual indication may save power. In some examples, the thermostat 165 may cease outputting the visual indication based on a output timer. Once the thermostat 165 starts outputting the visual indication, the thermostat 165 may also start an output timer. Once the output timer expires, the thermostat 165 may cease outputting the visual indication. In some examples, at block 690, the thermostat 165 may determine a duration of the outputting of the visual indication. That duration may be compared to a threshold. If the duration satisfies the threshold, the thermostat 165 may cease outputting the visual indication. In some examples, at block 695, the thermostat 165 may determine occupancy parameters of the building or the space and cease outputting the visual indication based on the occupancy parameters. For example, if no one is home, the thermostat 165 may cease outputting visual indication. Determining occupancy may be based on occupancy data 640 received from the server 155 or other entity.

In the illustrative examples discussed above, a thermostat 165 may communicate one or more states of the thermostat 165 and/or the HVAC system 605 using an indirect visual indicator such as, for example, a downcast light. In other examples, other states of the security and home automation system 100 may be communicated by indirect visual indications. In addition, devices other than the thermostat 165 may include an indirect visual indicator to communicate such states. For instance, the control panel 135 may be equipped with an indirect visual indicator, such as a downcast light, to communicate any number of states of operation of any number of systems in the security and home automation system 100. In addition, other computing devices of the security and home automation system 100 may be equipped with an indirect visual indicator (e.g., local computing devices 115, remote computing devices 120, other computing devices such as other wall-mounted controllers, or combinations thereof).

In other examples, the indirect visual indication may communicate other states of operation other than those associated with climate control and the HVAC system 605. For instance, an indirect visual indication may communicate whether a security is armed or unarmed. The indirect visual indication may use various characteristics of the indirect visual indication to communicate different states. For instances, the indirect visual indication may use color, pulsing, various patterns of output states, or combinations thereof to communicate states of the security and home automation system 100. The states communicated by the indirect visual indication may include states about any of the building management systems 160 (e.g., how they are operating), states about the computing devices that are outputting the visual indication, states about how the network is operating, states about how back-end equipment (e.g., server 155) are working, or combinations thereof. For example, the indirect indication may indicate whether the controlling computing device can communicate with the server 155.

Figure 7:
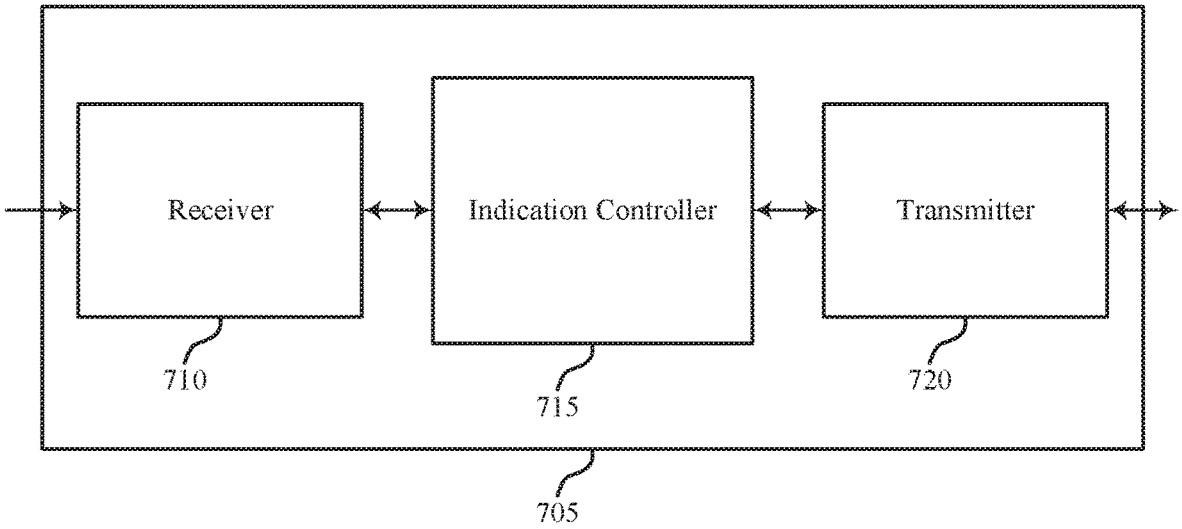
FIGS. 7 through 8 show block diagrams of a device with downcast light in accordance with aspects of the present disclosure.

FIG. 7 shows a block diagram 700 of a device 705 that supports a thermostat with downcast light in accordance with various aspects of the present disclosure. Device 705 may be an example of aspects of a computing device 115, 120, a control panel 135, or a thermostat 165 as described with reference to FIG. 1. Device 705 may include receiver 710, indication controller 715, transmitter 720, and 755. Device 705 may also include a processor. Each of these components may be in communication with one another (e.g., via one or more buses).

Receiver 710 may receive information such as packets, user data, or control information associated with various information channels (e.g., control channels, data channels, and information related to a thermostat with downcast light, etc.). Information may be passed on to other components of the device. The receiver 710 may be an example of aspects of the transceiver 335 described with reference to FIG. 3.

Indication controller 715 may be an example of aspects of the indication controller 315 described with reference to FIG. 3. Indication controller 715 and/or at least some of its various sub-components may be implemented in hardware, software executed by a processor, firmware, or any combination thereof. If implemented in software executed by a processor, the functions of the indication controller 715 and/or at least some of its various sub-components may be executed by a general-purpose processor, a digital signal processor (DSP), an ASIC, an FPGA, or other programmable logic device, discrete gate or transistor logic, discrete hardware components, or any combination thereof designed to perform the functions described in the present disclosure. The indication controller 715 and/or at least some of its various sub-components may be physically located at various positions, including being distributed such that portions of functions are implemented at different physical locations by one or more physical devices. In some examples, indication controller 715 and/or at least some of its various sub-components may be a separate and distinct component in accordance with various aspects of the present disclosure. In other examples, indication controller 715 and/or at least some of its various sub-components may be combined with one or more other hardware components, including but not limited to an I/O component, a transceiver, a network server, another computing device, one or more other components described in the present disclosure, or a combination thereof in accordance with various aspects of the present disclosure.

Indication controller 715 may identify a mode of operation of the device configured to automatically control a HVAC system, output a visual indication having a color based on the identified mode of operation, determine that a climate control system associated with the mode of operation is actively working, and pulse the visual indication to oscillate between a first output state and a second output state based on the device being in the mode of operation and the climate control system being active, the first output state being brighter than the second output state.

Transmitter 720 may transmit signals generated by other components of the device. In some examples, the transmitter 720 may be collocated with a receiver 710 in a transceiver module. For example, the transmitter 720 may be an example of aspects of the transceiver 335 described with reference to FIG. 3. The transmitter 720 may include a single antenna, or it may include a set of antennas.

Figure 8:
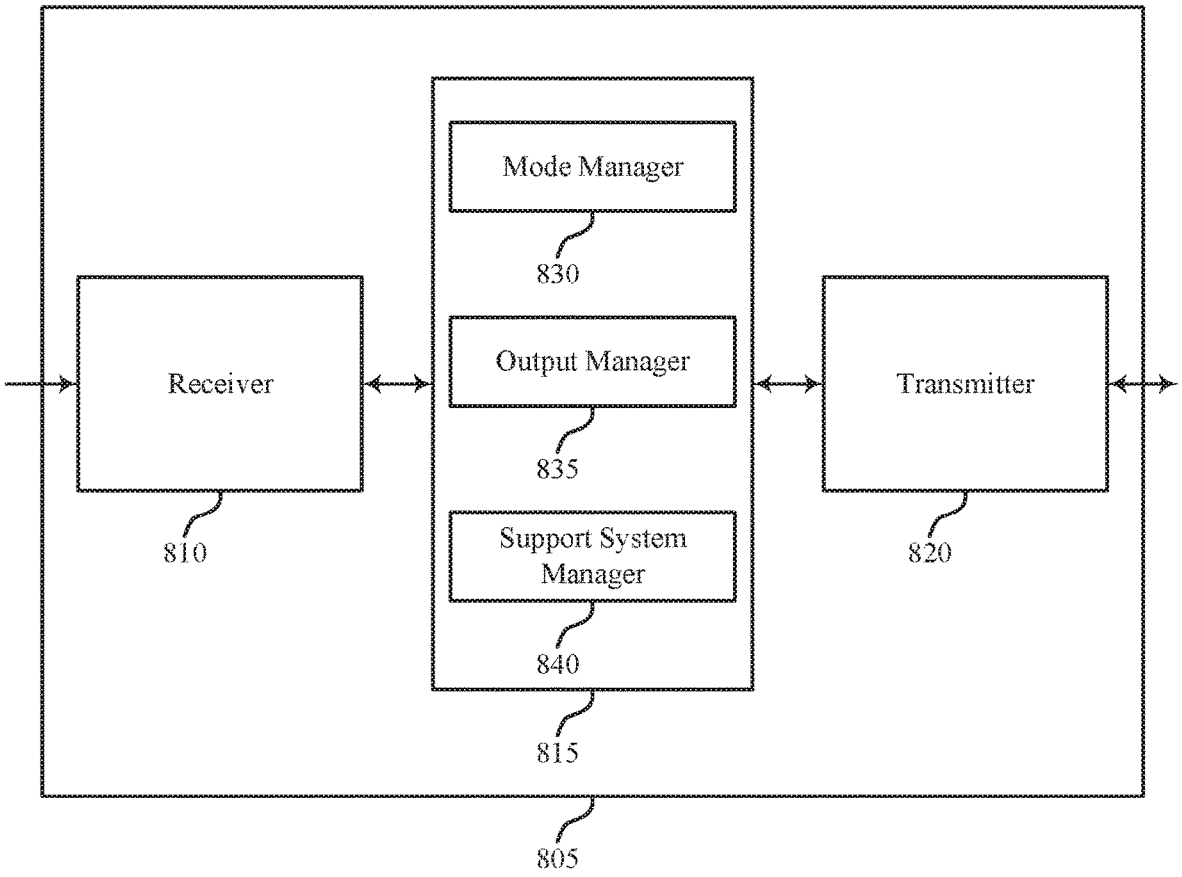

FIG. 8 shows a block diagram 800 of a device 805 that supports a thermostat with downcast light in accordance with various aspects of the present disclosure. Device 805 may be an example of aspects of a device 705, a computing device 115, 120, a control panel 135, or a thermostat 165 as described with reference to FIGS. 1 and 7. Device 805 may include receiver 810, indication controller 815, transmitter 820, and 855. Device 805 may also include a processor. Each of these components may be in communication with one another (e.g., via one or more buses).

Receiver 810 may receive information such as packets, user data, or control information associated with various information channels (e.g., control channels, data channels, and information related to a thermostat with downcast light, etc.). Information may be passed on to other components of the device. The receiver 810 may be an example of aspects of the transceiver 335 described with reference to FIG. 3.

Indication controller 815 may be an example of aspects of the indication controller 315 described with reference to FIG. 3. Indication controller 815 may also include mode manager 830, output manager 835, and support system manager 840.

Mode manager 830 may identify a mode of operation of the device configured to automatically control a HVAC system, identify the mode of operation as a heating mode, where the color of the visual indication is orange based on the device being in the heating mode, identify the mode of operation as a cooling mode, where the color of the visual indication is blue based on the device being in the cooling mode, and select the mode of operation based on a difference between a current temperature of a space associated with the device and a temperature set point or a target temperature.

Output manager 835 may output a visual indication having a color based on the identified mode of operation, pulse the visual indication to oscillate between a first output state and a second output state based on the device being in the mode of operation and the climate control system being active, the first output state being brighter than the second output state, modify the color of the visual indication to be orange, modify the color of the visual indication to be blue, determine a first brightness associated with the first output state and a second brightness associated with the second output state, determine a flash rate associated with the pulsing of the visual indication, where the first brightness, the second brightness, and the flash rate are based on a parameter of the device, determine a duration since the climate control system began actively working, where pulsing the visual indication is based on the duration satisfying a time threshold, determine a duration since the visual indication began to be output, and cease to output the visual indication based on the duration satisfying a time threshold.

Support system manager 840 may determine that a climate control system associated with the mode of operation is actively working, activate, by the device, a heating mode based on the current temperature being less than the temperature set point (e.g., a target temperature), activate, by the device, a cooling mode based on the current temperature being more than the temperature set point, and detect an occupancy parameter of a space associated with the device, where outputting the visual indication is based on the occupancy parameter. In some cases, the climate control system is an air conditioning system or an evaporative cooling system or a heating system.

Transmitter 820 may transmit signals generated by other components of the device. In some examples, the transmitter 820 may be collocated with a receiver 810 in a transceiver module. For example, the transmitter 820 may be an example of aspects of the transceiver 335 described with reference to FIG. 3. The transmitter 820 may include a single antenna, or it may include a set of antennas.

Figure 9:
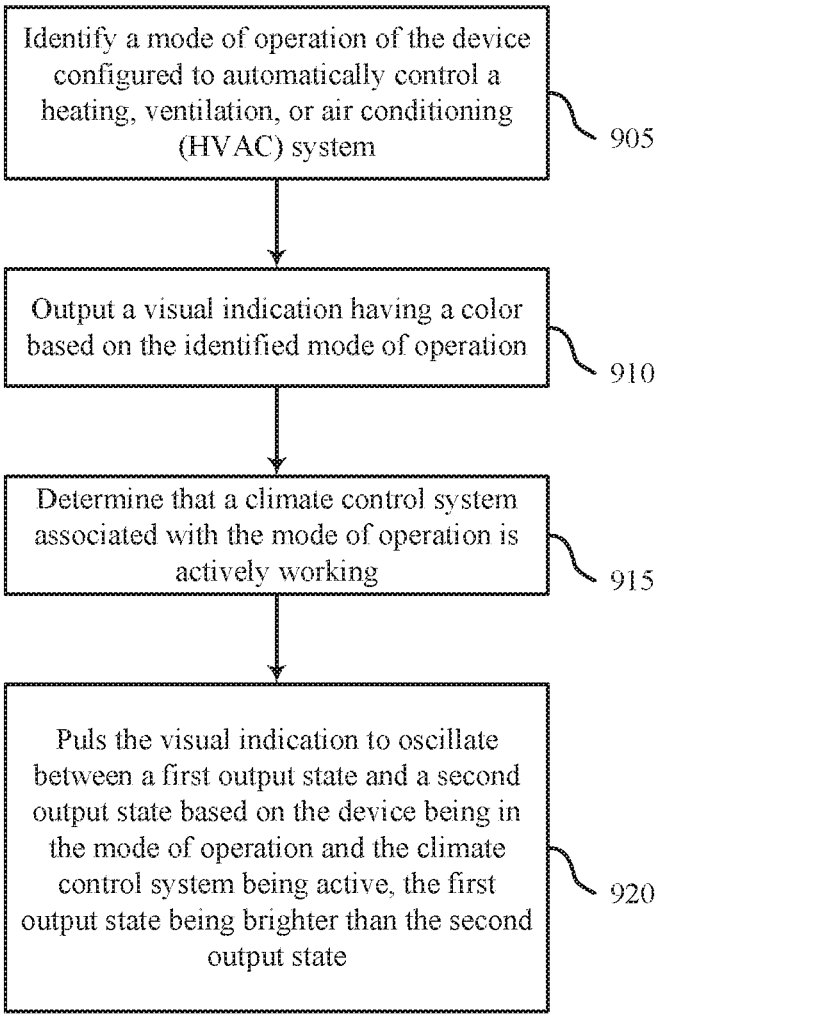
FIGS. 9 through 10 illustrate methods for a thermostat with downcast light in accordance with aspects of the present disclosure.

FIG. 9 shows a flowchart illustrating a method 900 for a thermostat with downcast light in accordance with various aspects of the present disclosure. The operations of method 900 may be implemented by a thermostat 165 or its components as described herein. For example, the operations of method 900 may be performed by an indication controller as described with reference to FIGS. 7 through 3. In some examples, a thermostat 165 may execute a set of codes to control the functional elements of the device to perform the functions described below. Additionally or alternatively, the thermostat 165 may perform aspects of the functions described below using special-purpose hardware.

At block 905 the thermostat 165 may identify a mode of operation of the device configured to automatically control a HVAC system. The operations of block 905 may be performed according to the methods described with reference to FIGS. 1 through 6. In certain examples, aspects of the operations of block 905 may be performed by a mode manager as described with reference to FIGS. 7 through 3.

At block 910 the thermostat 165 may output a visual indication having a color based at least in part on the identified mode of operation. The operations of block 910 may be performed according to the methods described with reference to FIGS. 1 through 6. In certain examples, aspects of the operations of block 910 may be performed by a output manager as described with reference to FIGS. 7 through 3.

At block 915 the thermostat 165 may determine that a climate control system associated with the mode of operation is actively working. The operations of block 915 may be performed according to the methods described with reference to FIGS. 1 through 6. In certain examples, aspects of the operations of block 915 may be performed by a support system manager as described with reference to FIGS. 7 through 3.

At block 920 the thermostat 165 may pulse the visual indication to oscillate between a first output state and a second output state based at least in part on the device being in the mode of operation and the climate control system being active, the first output state being brighter than the second output state. The operations of block 920 may be performed according to the methods described with reference to FIGS. 1 through 6. In certain examples, aspects of the operations of block 920 may be performed by a output manager as described with reference to FIGS. 7 through 3.

Figure 10:
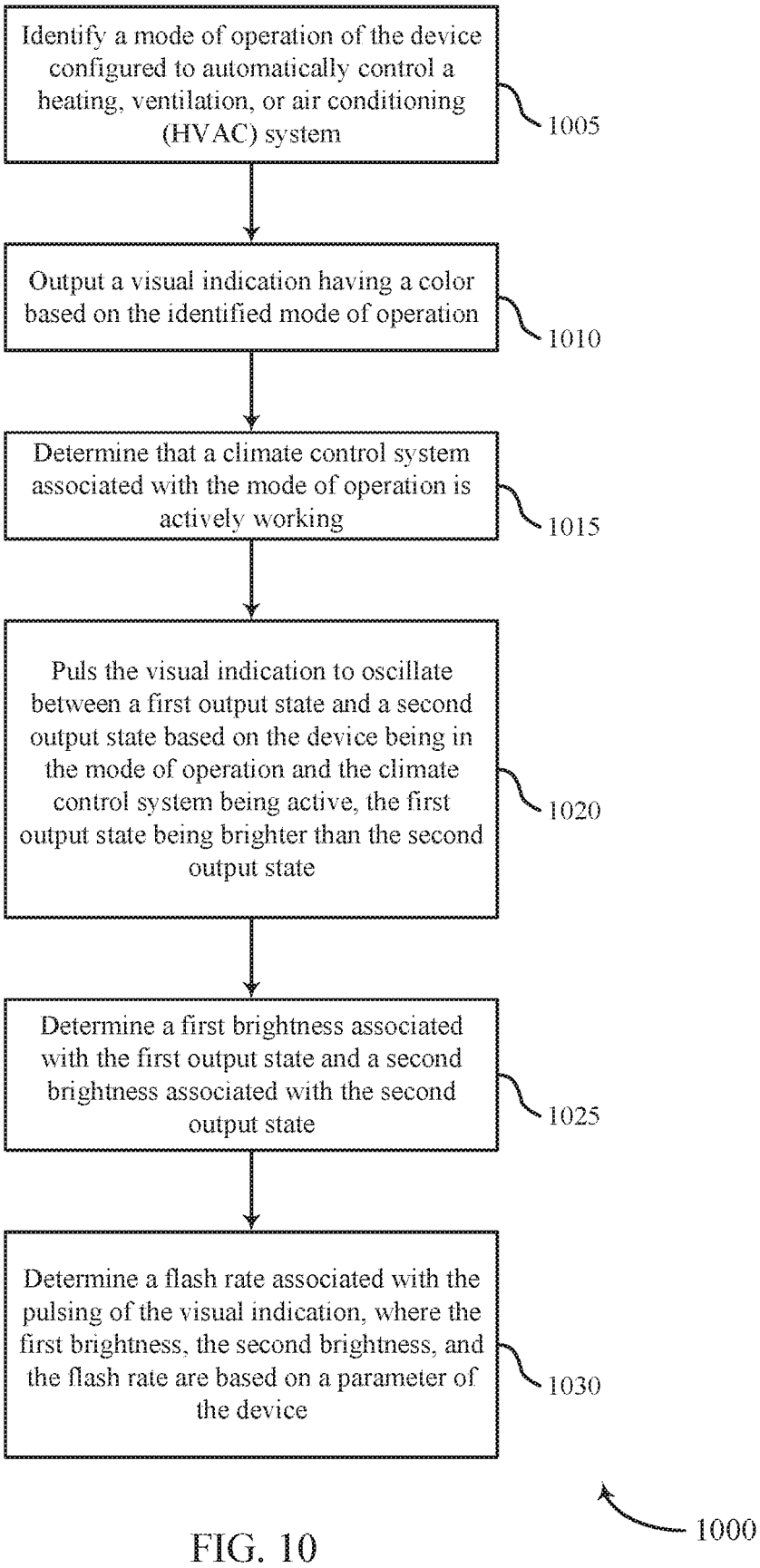

FIG. 10 shows a flowchart illustrating a method 1000 for a thermostat with downcast light in accordance with various aspects of the present disclosure. The operations of method 1000 may be implemented by a thermostat 165 or its components as described herein. For example, the operations of method 1000 may be performed by an indication controller as described with reference to FIGS. 7 through 3. In some examples, a thermostat 165 may execute a set of codes to control the functional elements of the device to perform the functions described below. Additionally or alternatively, the thermostat 165 may perform aspects of the functions described below using special-purpose hardware.

At block 1005 the thermostat 165 may identify a mode of operation of the device configured to automatically control a HVAC system. The operations of block 1005 may be performed according to the methods described with reference to FIGS. 1 through 6. In certain examples, aspects of the operations of block 1005 may be performed by a mode manager as described with reference to FIGS. 7 through 3.

At block 1010 the thermostat 165 may output a visual indication having a color based at least in part on the identified mode of operation. The operations of block 1010 may be performed according to the methods described with reference to FIGS. 1 through 6. In certain examples, aspects of the operations of block 1010 may be performed by a output manager as described with reference to FIGS. 7 through 3.

At block 1015 the thermostat 165 may determine that a climate control system associated with the mode of operation is actively working. The operations of block 1015 may be performed according to the methods described with reference to FIGS. 1 through 6. In certain examples, aspects of the operations of block 1015 may be performed by a support system manager as described with reference to FIGS. 7 through 3.

At block 1020 the thermostat 165 may pulse the visual indication to oscillate between a first output state and a second output state based at least in part on the device being in the mode of operation and the climate control system being active, the first output state being brighter than the second output state. The operations of block 1020 may be performed according to the methods described with reference to FIGS. 1 through 6. In certain examples, aspects of the operations of block 1020 may be performed by a output manager as described with reference to FIGS. 7 through 3.

At block 1025 the thermostat 165 may determine a first brightness associated with the first output state and a second brightness associated with the second output state. The operations of block 1025 may be performed according to the methods described with reference to FIGS. 1 through 6. In certain examples, aspects of the operations of block 1025 may be performed by a output manager as described with reference to FIGS. 7 through 3.

At block 1030 the thermostat 165 may determine a flash rate associated with the pulsing of the visual indication, wherein the first brightness, the second brightness, and the flash rate are based at least in part on a parameter of the device. The operations of block 1030 may be performed according to the methods described with reference to FIGS. 1 through 6. In certain examples, aspects of the operations of block 1030 may be performed by a output manager as described with reference to FIGS. 7 through 3.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration. An operating system utilized by the processor (or by I/O controller module or another module described above) may be iOS®, ANDROID®, MS-DOS®, MS-WINDOWS®, OS/2®, UNIX®, LINUX®, or another known operating system.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A device, comprising:

a processor and memory configured to automatically control a heating, ventilation, or air conditioning (HVAC) system;

a housing having a wall-facing side configured to mount to a wall, a user-facing side positioned opposite the wall-facing side, and a floor-facing side extending between the wall-facing side and the user-facing side; and a visual indicator positioned in an interior portion of the housing adjacent to the floor-facing side and configured to output a visual indication, the visual indication having a set of characteristics including a first characteristic that is modified based at least in part on a mode of operation of the device and a second characteristic that is modified based at least in part on a duration satisfying a time threshold since a climate control system associated with the mode of operation began, wherein the visual indicator projects the visual indication through an aperture of the floor-facing side onto a portion of the wall below the floor-facing side of the housing, and wherein the set of characteristics include a flash rate, a flash pattern, a brightness associated with flashing, a color, a periodicity, or any combination thereof.

2. The device of claim 1, wherein the housing defines an axis extending orthogonal to the wall-facing side, the visual indicator defines a center beam axis indicative of a center point of the visual indication output by the visual indicator, and the visual indicator is positioned such that the center beam axis forms an acute angle with the axis.

3. The device of claim 1, wherein the visual indication is a beam formed by the visual indicator having a beam width in a first direction and a beam height in a second direction perpendicular to the first direction, the beam width being larger than the beam height.

4. The device of claim 1, wherein the housing defines a first dimension in a first direction and a second dimension in a second direction orthogonal to the first direction; and the visual indication defines a third dimension in the first direction and a fourth dimension in the second direction, the fourth dimension being less than the second dimension.

5. The device of claim 1, wherein the visual indication extends downwardly away from a bottom edge of the housing.

6. The device of claim 1, further comprising:

a user interface configured to receive commands regarding a temperature set point and the mode of operation of the device.

7. The device of claim 1, further comprising:

a temperature sensor configured to identify a current temperature of a space associated with the device.

8. The device of claim 1, further comprising:

a communication system configured to communicate visual indication data with a security and automation system.

9. The device of claim 1, wherein the device is configured to operate according to the mode of operation, the mode of operation including a heating mode, a cooling mode, or a combination thereof.

10. The device of claim 1, wherein the visual indication is based at least in part on the mode of operation.

11. The device of claim 1, wherein the visual indication is configured to oscillate between a first output state and a second output state, the first output state being brighter than the second output state.

12. The device of claim 1, wherein the visual indication is based at least in part on an occupancy parameter.

13. A method for indicating an operating mode of a device, comprising:

identifying a mode of operation of the device configured to automatically control a heating, ventilation, or air conditioning (HVAC) system;

outputting a visual indication through an aperture of the device, the visual indication having a set of characteristics including a first characteristic that is modified based at least in part on the identified mode of operation and a second characteristic that is modified based at least in part on a duration satisfying a time threshold since a climate control system associated with the mode of operation began, wherein the set of characteristics include a flash rate, a flash pattern, a brightness associated with flashing, a color, a periodicity, or any combination thereof;

detecting an occupancy parameter of a space associated with the device; and ceasing to output the visual indication based at least in part on the occupancy parameter.

14. The method of claim 13, further comprising:

periodically receiving sensor data associated with the space from one or more sensors, wherein detecting the occupancy parameter is based at least in part on the sensor data received from the one or more sensors.

15. The method of claim 14, wherein the sensor data comprises at least one of camera data, motion sensor data, light detector data, audio data, radio frequency communication signal data, or a combination thereof.

16. The method of claim 13, further comprising:

modifying the mode of operation of the device from a first mode of operation to a second mode of operation based at least in part on the occupancy parameter.

17. The method of claim 16, further comprising:

detecting that the space is unoccupied based at least in part on the occupancy parameter, wherein modifying the mode of operation of the device from the first mode of operation to the second mode of operation comprises switching the device from an active mode of operation to an inactive mode of operation.

18. The method of claim 16, further comprising:

detecting that the space is occupied based at least in part on the occupancy parameter, wherein modifying the mode of operation of the device from the first mode of operation to the second mode of operation comprises switching the device from an inactive mode of operation to an active mode of operation.

19. An apparatus for indicating an operating mode of a device, in a system comprising:

a processor;

memory in electronic communication with the processor; and instructions stored in the memory and operable, when executed by the processor, to cause the apparatus to:

identify a mode of operation of the device configured to automatically control a heating, ventilation, or air conditioning (HVAC) system;

output a visual indication through an aperture of the device, the visual indication having a set of characteristics including a first characteristic that is modified based at least in part on the identified mode of operation and a second characteristic that is modified based at least in part on a duration satisfying a time threshold since a climate control system associated with the mode of operation began, wherein the set of characteristics include a flash rate, a flash pattern, a brightness associated with flashing, a color, a periodicity, or any combination thereof;

detect an occupancy parameter of a space associated with the device; and cease to output the visual indication based at least in part on the occupancy parameter.

20. The apparatus of claim 19, wherein the instructions are further executable by the processor to:

receive sensor data for a threshold period of time from one or more sensors, wherein detecting the occupancy parameter is based at least in part on the sensor data received from the one or more sensors.

* * * * *